US005364054A

United States Patent [19]

Miller et al.

[11] Patent Number: 5,364,054

[45] Date of Patent: Nov. 15, 1994

[54] HOOK FOR ATTACHING A BOAT COVER

[76] Inventors: Ricky D. Miller, 7620 Iverson St., Cottage Grove, Minn. 55016; Bruce A. Reeve, 1429 E. 6th St., St. Paul, Minn. 55106

[21] Appl. No.: 11,877

[22] Filed: Feb. 1, 1993

[51] Int. Cl.[5] ..... F16B 45/00

[52] U.S. Cl. ..... 248/304; 224/42.39; 248/499; 410/100

[58] Field of Search ..... 248/304, 499, 503, 505, 248/214, 215, 340; 224/42.4, 42.39, 42.46 R; 410/80, 85, 100

[56] References Cited

U.S. PATENT DOCUMENTS

| | | | |
|---|---|---|---|
| 1,532,461 | 4/1925 | Willerscheid | 224/42.39 |
| 1,814,371 | 7/1931 | Desmond | 224/42.39 X |
| 4,243,350 | 1/1981 | Hall | 410/100 |
| 4,648,765 | 3/1987 | Kovaleski | 248/499 X |
| 4,657,062 | 4/1987 | Tuerk | 248/499 X |
| 4,971,279 | 11/1990 | George | 248/340 X |
| 5,014,890 | 5/1991 | Perry | 248/499 X |
| 5,159,729 | 11/1992 | Walker | 248/499 X |
| 5,193,955 | 3/1993 | Chou | 410/100 |
| 5,282,706 | 2/1994 | Anthony | 410/100 |

*Primary Examiner*—J. Franklin Foss
*Attorney, Agent, or Firm*—Thomas B. Tate

[57] ABSTRACT

A hook for attaching a boat cover to a boat trailer. The hook comprises a long vertical member having an opening through which a cord or rope can be placed, a horizontal member positioned perpendicular to the bottom of the vertical member, a shorter vertical member perpendicular to the distal end of the horizontal member so as to define an opening into which the bar of the boat trailer fits, and a horizontal cantilevered member, projecting from the long vertical member, which fits across the top of the trailer bar.

1 Claim, 1 Drawing Sheet

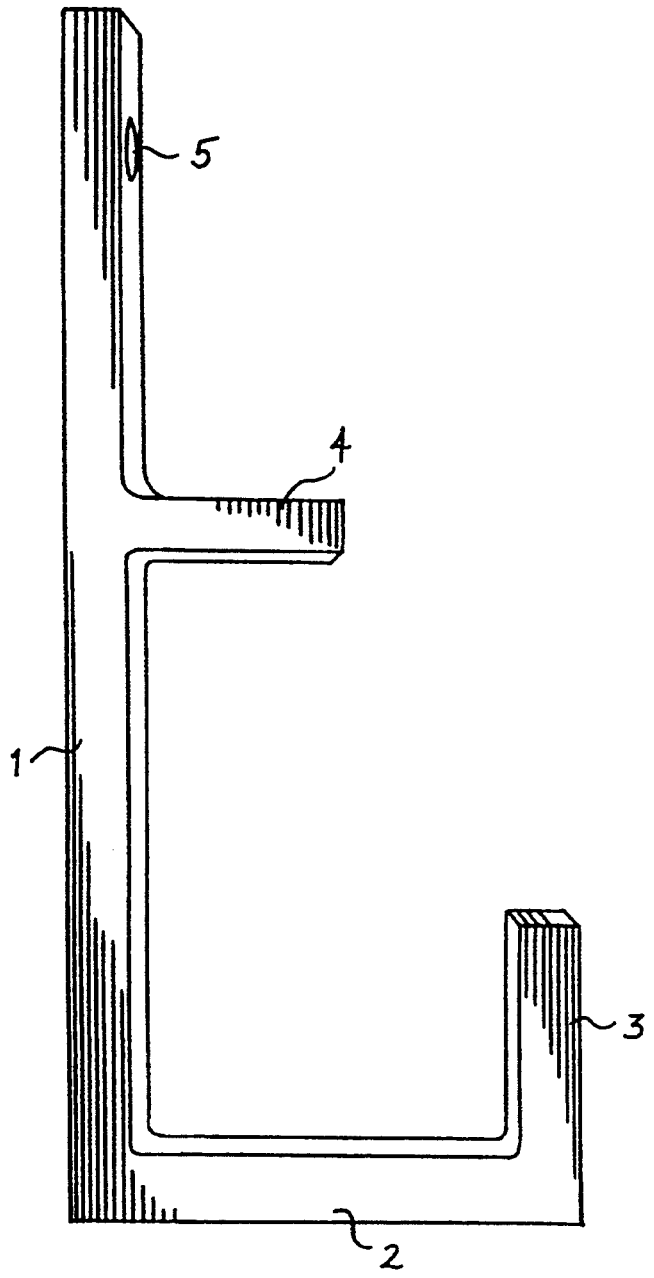
5
4
1
3
2

HOOK FOR ATTACHING A BOAT COVER

SUMMARY AND BACKGROUND OF THE INVENTION

At present, a boat cover is attached by tying ropes around the boat cover, under the bottom of the boat and over the opposite side of the boat, and tying the topes to the cover again. This is a cumbersome and time-consuming process.

The invention is a hook for attaching a boat cover to the boat trailer rather than to the boat itself. The primary object of the invention is to provide an easier way to attach a boat cover by providing a means to hook the boat cover to the bar of the boat trailer frame without the need for any tightening mechanisms.

DESCRIPTION OF THE DRAWING

The figure is a side view.

DESCRIPTION OF THE INVENTION

The hook is made of high strength plastic molded in one piece. It comprises a long vertical member 1, a horizontal member 2 projecting perpendicularly from the bottom of vertical member 1, a shorter vertical member 3 projecting perpendicular from the end of horizontal member 2 which is distal to vertical member 1, a cantilevered horizontal member 4 projecting perpendicularly from vertical member 1 in spaced relation parallel to horizontal member 2, and an opening 5 formed near the top end of vertical member 1, said opening 5 being of sufficient size for a bungee cord or rope to pass therethrough. The bungee cord or rope is attached to the underside of the boat cover.

The hook can be made in any of several sizes in order to fit onto different sizes of trailers. A common size for the bar of a boat trailer is two inches wide by three inches high. To fit this size bar, the hook would be of the following dimensions: the vertical member 1 is six inches long, the inside dimension of the spaced formed between vertical members 1 and 3 is two inches, and the cantilevered member 4 is one inch long and is positioned three inches above the horizontal member 2. To apply the hook to the bar, the hook is tilted diagonally to allow the bar to fit into the space between vertical members 1 and 3, and then is snapped into position so that the bar fits snugly between the various members of the hook. Vertical members 1 and 3 rest against opposite sides of the bar, horizontal member 2 rests against the bottom of the bar, and cantilevered horizontal member 4 rests against the top of the bar and restricts downward movement of the hook to prevent the hook from dislodging when travelling over rough terrain.

We claim:

1. A hook for attaching a boat cover to the bar of a boat trailer, said hook comprising:

a first, long, vertical member which has an opening formed through it near the upper end of said member, said opening being of sufficient size for a cord or rope to be passed therethrough and attached to said boat cover;

a first horizontal member projecting perpendicularly from the bottom end of said first vertical member;

a second, short, vertical member projecting perpendicularly from the end of said first horizontal member which is distal to said first vertical member, said second vertical member being positioned parallel and in spaced relation to said first vertical member at a distance approximately equal to the width of said bar of said boat trailer;

a second, cantilevered, horizontal member projecting perpendicularly from said first vertical member, said second horizontal member being positioned parallel and in spaced relation to said first horizontal member at a distance approximately equal to the height of said bar of said boat trailer.

* * * * *